US006629908B2

(12) United States Patent
Hamady

(10) Patent No.: US 6,629,908 B2
(45) Date of Patent: Oct. 7, 2003

(54) PRECESSIONAL APPARATUS AND METHOD THEREOF

(76) Inventor: Peter Winston Hamady, 202 Riverside Dr., #7A, New York, NY (US) 10025

( * ) Notice: Subject to any disclaimer, the term of this patent is extended or adjusted under 35 U.S.C. 154(b) by 99 days.

(21) Appl. No.: 09/808,863

(22) Filed: Mar. 15, 2001

(65) Prior Publication Data

US 2001/0036884 A1 Nov. 1, 2001

Related U.S. Application Data

(60) Provisional application No. 60/203,083, filed on May 9, 2000.

(51) Int. Cl.[7] ..... A63B 21/22
(52) U.S. Cl. ..... 482/45; 482/44; 482/110
(58) Field of Search ..... 482/45, 44, 46, 482/110, 114, 148, 49, 50; 472/137

(56) References Cited

U.S. PATENT DOCUMENTS

| | | | | |
|---|---|---|---|---|
| 646,217 | A | 3/1900 | Kingsley-Field | |
| 850,938 | A | 4/1907 | Kellogg et al. | |
| 942,952 | A | 12/1909 | Wrather | |
| 1,058,786 | A | 4/1913 | Newkirk et al. | |
| 1,175,372 | A | 3/1916 | Newcomb | 446/246 |
| 1,250,266 | A | 12/1917 | Banks | |
| 2,747,326 | A | 5/1956 | Doyle | |
| 2,762,123 | A | 9/1956 | Schultz et al. | |
| 2,999,390 | A | 9/1961 | Bosch et al. | |
| 3,071,977 | A | 1/1963 | Bosch et al. | |
| 3,141,669 | A | 7/1964 | Chul | |
| 3,164,382 | A | 1/1965 | Johnson | |
| 3,276,777 | A | 10/1966 | Pruitt | |
| 3,320,819 | A | 5/1967 | Riordan | |
| 3,439,548 | A | 4/1969 | Horvath | 74/5.34 |
| 3,451,275 | A | 6/1969 | Atkin | 74/5.34 |
| 3,482,835 | A | 12/1969 | Dean | 272/84 |
| 3,617,056 | A | 11/1971 | Herbold | 272/84 |
| 3,648,525 | A | 3/1972 | Reed | 74/5.34 |
| 3,719,074 | A | 3/1973 | Lynch | 73/505 |

(List continued on next page.)

FOREIGN PATENT DOCUMENTS

| | | | |
|---|---|---|---|
| DE | 374175 | 10/1920 | |
| DE | 1548544 | 10/1966 | |
| DE | 2825490 A1 | 12/1979 | F03G/7/00 |
| DE | 3523160 A1 | 1/1987 | B64G/1/28 |
| FR | 2 293 608 | 12/1974 | F03G/3/08 |
| GB | 29906 | 12/1912 | |
| GB | 13-238 | 4/1913 | |
| GB | 646217 | 11/1990 | |
| JP | 60-561182 | 1/1985 | F03G/7/00 |
| RU | 2004275 C1 | 12/1991 | |
| RU | 2000829 C1 | 10/1993 | |
| SU | 1769901 A1 | 8/1990 | |

*Primary Examiner*—Jerome W. Donnelly
(74) *Attorney, Agent, or Firm*—Pennie & Edmonds LLP

(57) ABSTRACT

A precessional gyroscopic exercise device includes a housing containing a tiltable rotor assembly. The housing and the rotor assembly may be coupled together by a tilt assembly that defines a fixed precession axis for the rotor assembly and allows the rotor assembly to be tilted relative to the fixed precession axis. When the rotor is spinning, and the rotor assembly is tilted contact between the spinning axle and the interior surfaces of a circumferential channel in the housing causes the rotor assembly to rotate about the fixed precession axis, producing a gyroscopic precessional torque—this torque, and resultant wobbling of the device, is opposed by the user for the exercise effect. The tilting mechanism may be associated with handles on the outside of the device, allowing the user to selectively control the tilting of the rotor assembly. The handles may be rotatably coupled to the device, permitting operation of the device using a pedaling motion. The handles are preferably located on the device on or near the precession axis. An alternate embodiment of the device has no tilting assembly or channel, and the spin and/or precession of the rotor assembly is motor-driven.

19 Claims, 8 Drawing Sheets

U.S. PATENT DOCUMENTS

| | | | | |
|---|---|---|---|---|
| 3,726,146 | A | 4/1973 | Mishler | 74/5 |
| 3,737,162 | A | 6/1973 | Wood | 272/68 |
| 3,742,770 | A | 7/1973 | Flannelly | 74/5.34 |
| 3,756,592 | A | 9/1973 | Johnson | 272/57 |
| 3,784,363 | A | 1/1974 | Flannelly | 74/5.34 |
| 3,805,625 | A | 4/1974 | Schlitt | 74/5.34 |
| 3,841,627 | A | 10/1974 | Vetter | 272/79 |
| 3,843,117 | A | 10/1974 | Johnson | 272/57 |
| 3,858,328 | A | 1/1975 | La Rose | 33/317 |
| 3,901,503 | A | 8/1975 | Klose | 272/57 |
| 4,077,626 | A | 3/1978 | Newman | 272/128 |
| 4,110,631 | A | 8/1978 | Salter | 290/55 |
| 4,150,580 | A | 4/1979 | Silkebakken et al. | 74/5 R |
| 4,302,006 | A | 11/1981 | Johnson | 272/115 |
| 4,343,203 | A | 8/1982 | Jacobson et al. | 74/5 R |
| 4,361,055 | A | 11/1982 | Kinson | 74/5.22 |
| 4,387,512 | A | 6/1983 | Gorski et al. | 74/8.34 X |
| 4,448,086 | A | 5/1984 | Kennel | 74/5 R |
| 4,461,176 | A | 7/1984 | Nearman et al. | 73/504 |
| 4,472,978 | A | 9/1984 | Levine et al. | 74/5.34 |
| 4,528,864 | A | 7/1985 | Craig | 74/5.34 |
| 4,655,096 | A | 4/1987 | Westhaver et al. | 64/5 F |
| 4,658,659 | A | 4/1987 | Gruber | 74/5.46 |
| 4,684,124 | A | 8/1987 | Escher | 272/128 |
| 4,712,439 | A | 12/1987 | North | 74/84 R |
| 4,799,667 | A | 1/1989 | Suchy | 272/36 |
| 4,824,099 | A | 4/1989 | Rusu et al. | 272/33 |
| 4,825,716 | A | 5/1989 | Roberts et al. | 74/5.34 |
| 4,951,514 | A | 8/1990 | Gubin | 74/5.37 |
| D315,437 | S | 3/1991 | Stein | D21/198 |
| 5,024,112 | A | 6/1991 | Kidd | 74/5.37 |
| 5,046,721 | A | 9/1991 | Altare | 272/36 |
| 5,058,571 | A | 10/1991 | Hall | 128/46 |
| 5,090,260 | A | 2/1992 | Delroy | 74/5.37 |
| 5,092,581 | A | 3/1992 | Koz | 272/72 |
| 5,150,625 | A | 9/1992 | Mishler | 74/5 R |
| 5,184,521 | A | 2/1993 | Tyler | 74/5.34 |
| 5,243,868 | A | 9/1993 | Schonberger | 74/64 |
| 5,256,942 | A | 10/1993 | Wood | 318/649 |
| 5,259,571 | A | 11/1993 | Blazquez | 244/12.2 |
| 5,297,052 | A | 3/1994 | McIntyre et al. | 364/453 |
| 5,335,561 | A | 8/1994 | Harvey | 24/84 R |
| 5,342,244 | A | 8/1994 | Nelson | 472/14 |
| D350,796 | S | 9/1994 | Pravitz | D21/198 |
| 5,360,363 | A | 11/1994 | Levin | 446/46 |
| D365,612 | S | 12/1995 | Pravitz | D21/198 |
| 5,517,205 | A | 5/1996 | van Heyningen et al. | 343/765 |
| 5,594,169 | A | 1/1997 | Field et al. | 73/504.14 |
| D381,719 | S | 7/1997 | Pravitz | D21/98 |
| 5,766,112 | A | 6/1998 | Chuan | 482/44 |
| 5,800,311 | A | 9/1998 | Chuang | 482/44 |
| 5,871,249 | A | 2/1999 | Williams | 74/5.34 X |
| 6,053,846 | A * | 4/2000 | Lin | 482/44 |
| 6,461,276 | B1 * | 10/2002 | Yu | 482/44 |
| 6,488,613 | B1 * | 12/2002 | Domenge | 482/110 |

* cited by examiner

PRECESSIONAL APPARATUS AND METHOD THEREOF

CROSS-REFERENCE TO RELATED APPLICATION

This is a nonprovisional application claiming the benefit of United States Provisional Patent Application Ser. No. 60/203,083, filed May 9, 2000, which is hereby incorporated by reference.

TECHNICAL FIELD

The present invention relates to precessional gyroscopic exercise devices for exercising both the upper and/or lower body. More specifically the present invention relates to a precessional gyroscopic exercise device having a housing with handles connected thereto, and the use of such a device.

BACKGROUND OF THE INVENTION

Precessional exercise devices are known and typically require a user to grasp the device with his hand. For example, in one gyroscopic exerciser as disclosed in U.S. Pat. No. 3,276,146 to Mishler, a rotor is mounted within a housing and a portion of the rotor is exposed through an open portion of the housing to permit manual spinning of the rotor. By manually giving the rotor an initial spin about its shaft or spin axis and then manipulating the device, the rotor is caused to precess about an axis substantially at right angles to the spin axis. This precession of the spinning rotor causes a precessional torque to be generated. The manual application of an opposing torque by a user provides the exercise effect.

It is also known to provide various mechanisms for a user to engage a precessional exercise device. For example, U.S. Pat. No. 6,053,846 to Lin discloses a wrist exerciser having a shell which is provided with rigidly-attached protruding plate members which serve as handles. U.S. Pat. No. Des. 351,437 to Previews discloses a gyroscopic exerciser with a single elongated handle rigidly attached to the housing, while U.S. Pat. No. Des. 350,796 to Previews discloses two opposing elongated handles rigidly attached to the housing. Precessional torque in these known devices is translated to the handle(s), and provides an exercise effect when a user holds the handle(s) and resists the torque generated by the device. These known mechanisms for a user to engage a precessional exercise device do not permit the device to be used in a way to exercise major muscle groups beyond those of the lower arm. Based on the way such devices are necessarily held by the user, they only exercise a limited set of muscles, primarily those of the hand, wrist, and forearm.

In all of these known precessional exercise systems, the mechanism by which the user holds or engages the device is rigid with regard to the housing. As a result, the user is simply providing correctional torques to counter the gyroscopic wobbling of the device, and cannot perform a variety of motions providing exercise of a variety of muscle groups. Accordingly, there is a need in the art for a precessional exercise device in which the user can perform a variety of motions, thereby exercising a variety of muscle groups.

Furthermore, in all of these known devices, the handles are located in the plane of precession of the rotor (i.e., the plane in which the spin axis of the rotor during its precession, in the average, coincident with the physical channel provided to support the ends of the rotor shaft), offset by 90 degrees from the axis of precession. To operate a precessional device, the axis of precession must be continuously deflected. To impart such a deflection with handles located on the plane of precession requires a large degree of articulation and use of the wrist joint—thus it is difficult, if not impossible, to manipulate these handles in a circular motion to gyroscopically operate the device. Thus, there is a need in the art for a gyroscopic precessional exercise device in which the handles can be manipulated in a circular motion to operate the device.

SUMMARY OF THE INVENTION

One variation of the present invention provides an apparatus including: a housing having a precession axis; a rotor assembly comprising a rotor and an axle, the axle having a longitudinal axis defining a spin axis for the rotor; and first and second handles, each handle being movably coupled to the housing. The rotor is rotatable relative to the housing about the spin axis, and the rotor assembly is rotatable relative to the housing about the precession axis. The rotor assembly may also be tiltable relative to the housing.

The apparatus of this variation may include a motor, which is selectively operable by the user to control or contribute to the spin of the rotor about the spin axis. The apparatus may also include a second motor, which is selectively operable by the user to control the precession of the rotor assembly about the precession axis. An electrical generator may also be used, that electrical generator being selectively operable by the user to generate electrical energy from the rotational energy associated with the spin of the rotor about the spin axis and/or the rotation of the rotor assembly about the precession axis.

The movable coupling of the handles to the housing may be a rotational coupling, in which case each handle can have an associated crank axis, and each handle is rotatable, about its crank axis, relative to the housing. Each handle is moveable in a circular path in a plane substantially perpendicular to its crank axis, and each handle remains in substantially the same orientation during its motion in the circular path. The motion of the first and second handles in their circular paths contributes to the rotation of the rotor assembly about the precession axis. The crank axes of the first and second handles may be arranged to be substantially parallel, and also may be offset from each other. The handles are preferably located on or near the precession axis.

Thus, a variation of the present invention is disclosed of an apparatus including: a housing; a rotor assembly comprising a rotor and an axle. The axle has a longitudinal axis defining a spin axis for the rotor, and the rotor assembly is freely rotatable within the housing. Accordingly, the rotor is rotatable relative to the housing about the spin axis, and the rotor assembly is rotatable relative to the housing about a precession axis substantially perpendicular to the spin axis. Also, the rotor assembly is tiltable relative to the housing. The apparatus further includes first and second handles rotatably coupled to the housing. Each handle has a crank axis, the crank axes being offset from each other, and each handle is rotatable, about its crank axis, relative to the housing. Each handle is movable in a circular path in a plane substantially perpendicular to its crank axis, and the rotatable coupling of the handles to the housing allows each handle to remain in substantially the same orientation during its motion in the circular path.

Another variation of the present invention provides an apparatus including: a housing having a precession axis; a rotor assembly comprising a rotor and an axle, the axle having a longitudinal axis defining a spin axis for the rotor; a precession plane substantially perpendicular to the precession axis; and first and second handles coupled to housing, offset from the precession plane. The rotor is rotatable relative to the housing about the spin axis, and the rotor assembly is rotatable relative to the housing about the precession axis. The rotor assembly may also be tiltable relative to the housing. The handles are preferably located along or near the precession axis.

The apparatus of this variation may further include a motor which is selectively operable to contribute to or control the spin of the rotor about the spin axis. The apparatus may further include a second motor which is selectively operable to control the rotation of the rotor assembly about the precession axis. An electrical generator may also be included, generator being selectively operable to generate electrical energy from the rotational energy associated with the spin of the rotor about the spin axis or the rotation of the rotor assembly about the precession axis. In this variation, the handles may be either rigidly or movably coupled to the housing. If movably coupled, the movable coupling may be a universal joint or a rotational coupling.

If the handles are movably coupled to the housing by a rotational coupling, each handle has an associated crank axis, and each handle is rotatable, about its crank axis, relative to the housing. The crank axes of the first and second handles may be substantially parallel, and may be offset from each other. Each handle is movable in a circular path in a plane substantially perpendicular to its crank axis, and each handle remains in substantially the same orientation during its motion in the circular path. The motion of the first and second handles in their circular paths contributes to the rotation of the rotor assembly about the precession axis.

Thus, a variation of the present invention is disclosed of an apparatus including: a housing having a precession axis, and a rotor assembly comprising a rotor and an axle. The axle has a longitudinal axis defining a spin axis for the rotor. The rotor assembly is freely rotatable within the housing such that: the rotor is rotatable relative to the housing about the spin axis, the rotor assembly is rotatable relative to the housing about the precession axis, and the rotor assembly is tiltable relative to the housing. The apparatus further includes a precession plane substantially perpendicular to the precession axis, and first and second handles movably coupled to the housing along or near the precession axis.

Another variation of the present invention provides an apparatus including: a housing having a precession axis, and a rotor assembly comprising a rotor and an axle. The axle has a longitudinal axis defining a spin axis for the rotor, and the rotor has an associated rotor plane substantially perpendicular to the spin axis. The apparatus further includes at least one tilt assembly coupling the rotor assembly to the housing and defining a precession axis for the rotor assembly. The rotor is rotatable about the spin axis relative to the housing, the rotor assembly is rotatable about the precession axis relative to the housing, and the tilt assembly is selectively operable to tilt the rotor plane relative to the precession axis.

The apparatus of this variation may further include a circular channel positioned within the housing. First and second ends of the axle are fitted in the channel. The at least one tilt assembly is adjustable between a first position in which the rotor plane and precession axis are substantially coincident, and a second position in which the rotor plane is tilted relative to the precession axis by a tilt angle. The tilt angle is preferably in the range of about 0.5 degrees to about 3 degrees, and more preferably in the range of about 1 degree to about 2 degrees. When the at least one tilt assembly is in the first position, the axle is not in contact with the channel, and when the at least one tilt assembly is in the second position, the axle contacts the channel.

In this variation, each of the at least one tilt assemblies may include a first linkage assembly associated with the rotor assembly and a second linkage assembly associated with the housing. The first and second linkage assemblies are operatively associated to adjust the tilt assembly between the first and second positions—when the tilt assembly is in the first position, the axle is not in contact with the channel, and when the tilt assembly is in the second position the axle contacts the channel. The second linkage assembly may comprise a reciprocating member that extends from inside the housing to outside the housing, and the second linkage assembly may provide a biasing force (for example with a spring) biasing the first linkage member so as to maintain the tilt assembly in the first position. A handle may be associated with each of the at least one tilt assemblies, such that the tilt assemblies may be adjusted between the first and second positions by selective application of a bias-overcoming force on the handle by a user—when the user applies no force to the handle, the tilt assembly is maintained in the first position by the biasing force. At least part of the at least one tilt assembly may be rotatable relative to the housing.

A method of exercising is disclosed, the method including: providing an exercise device comprising: engaging the handles by the user; activating the rotor and the tilt assemblies, thereby spinning the rotor and tilting the rotor plane, thereby producing a gyroscopic precessional torque and inducing a wobbling motion in the housing; and providing a force counter to the induced motion by moving the handles in a circular pedaling motion; thereby exercising the user. The exercise device provided includes: a housing having a precession axis, and a rotor assembly comprising a rotor and an axle. The axle has a longitudinal axis defining a spin axis for the rotor assembly, and the rotor has an associated rotor plane substantially perpendicular to the spin axis. The device further includes two tilt assemblies coupling the rotor assembly to the housing and defining a precession axis for the rotor assembly, and handles associated with each of the tilt assemblies. The rotor is rotatable about the spin axis within the housing, the rotor assembly is rotatable about the precession axis within the housing, and the tilt assembly is selectively operable to tilt the rotor plane relative to the precession axis.

Another variation of the present invention provides an apparatus including: a rotor having a spin axis, and a housing containing the rotor, the housing having a precession axis substantially perpendicular to the spin axis. Rotation of the rotor about the spin axis is driven by a motor, and rotation of the rotor about the precession axis is driven by a motor. The same motor may drive rotation of the rotor about both the spin and precession axes, or a first motor may drive the rotation of the rotor about the spin axis and a second motor drive the rotation of the rotor about the precession axis. The apparatus of this variation may further include at least one externally positioned handle. The handle(s) may be either rigidly or movably coupled to the housing.

Additional features and advantages of the present invention will become more apparent from the following detailed description, drawings and claims.

BRIEF DESCRIPTION OF THE DRAWINGS

The features and advantages of the present invention will become more readily apparent from the following detailed description of the invention in which like elements are labeled similarly and in which.

DETAILED DESCRIPTION OF THE PREFERRED EMBODIMENTS

Figure 1:
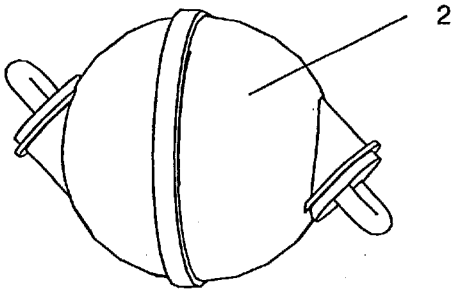
FIG. 1 is a front view of an embodiment of the precessional device of the present invention.
Figure 2:
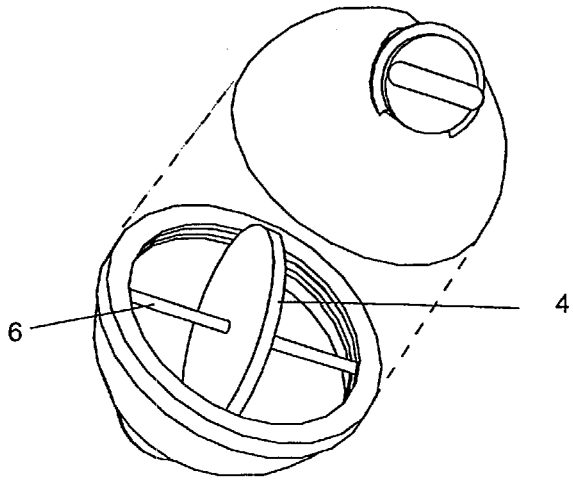
FIGS. 2 and 3 are different perspective views of a partially-exploded precessional device of FIG. 1.

The precessional gyroscopic exercise device includes a rotor assembly disposed within a housing. The rotor assembly includes a rotor and an axle, and optionally a yoke and an electrical power source. The rotor can rotate or spin around a spin axis defined by the longitudinal axis of the axle. The spin axis can be tilted relative to the housing. The entire rotor assembly can rotate, or precess, about a precession axis which is generally orthogonal to the plane containing the spin axis in its nominal position.

Reference will now be made in detail to the various, non-limiting embodiments of the present invention, examples of which are illustrated in the accompanying drawings. Wherever possible, the same reference numbers will be used throughout the drawings to refer to the same or like parts.

As best seen in FIGS. 1–4, the exercise device has a shell or housing 2, which contains rotor 4 and associated axle 6. The housing is preferably spherical or ellipsoidal as illustrated, but may be of any appropriate shape. Housing 2 may be formed from two hollow shell pieces 5 each having a circumferential mating surface 7. The mating surfaces are associated with opposite sides 12 of an interposed track 10. The track defines a channel 14 (best seen in FIGS. 11 and 12) which cooperatively receives the ends of the axle 6. The channel may alternatively be formed directly in the interior surface of the housing, thereby obviating the need for a separate track piece.

Because the axle is freely guided by the channel, the rotor is free to spin (i.e., to rotate about the spin axis "$A_S$" defined as the longitudinal axis of the axle). Furthermore, the entire rotor assembly 40 (which includes the rotor 4 and the axle 6) is freely rotational relative to the housing such that it can rotate relative to the housing and channel. Specifically, as the ends of the axle 6 sweep out a circle (moving within the channel 14 in the embodiment having a channel), the rotor assembly rotates about a precession axis "$A_P$" which is perpendicular to a precession plane ("$P_P$" best seen in FIGS. 11 and 12). The precession plane is also the plane swept out by the axle in its nominal (untilted) state. In the embodiments of the invention which have a channel, the precession plane may also be understood as the plane of the channel ("$P_C$")

Figure 3:
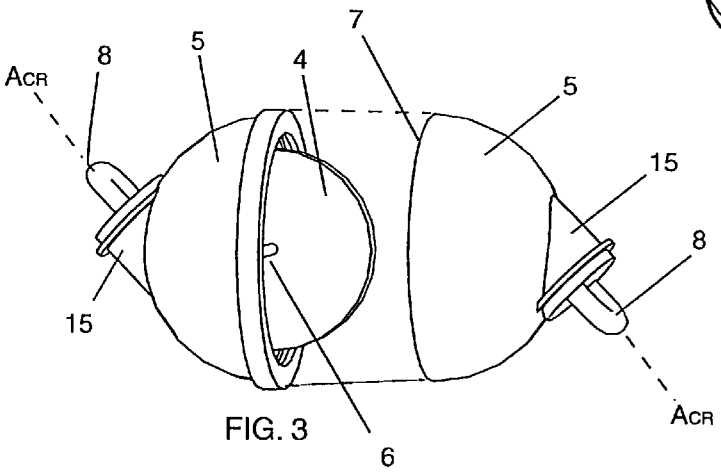
Figure 4:
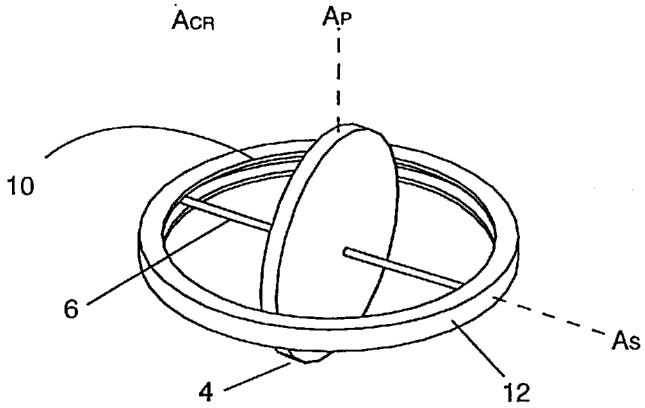
FIG. 4 is a perspective view of the rotor, axle, and channel of the precessional device of FIG. 1.

As shown in FIG. 3, the device preferably has two handles 8, attached to the device via a handle-coupling portion 15. The handles are positioned so as to be located at generally opposed positions on the exterior of the housing 2. The handles may be rigidly or movably coupled to the housing.

Figure 13:
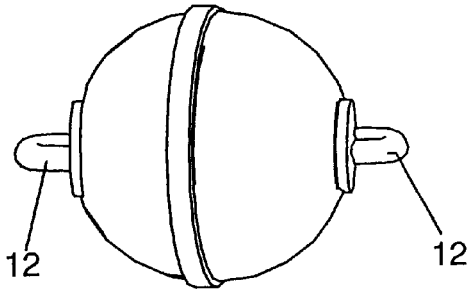
FIGS. 13 and 14 are external perspective views of the precessional device of the present invention, in an embodiment having handles fixed to the housing.
Figure 14:
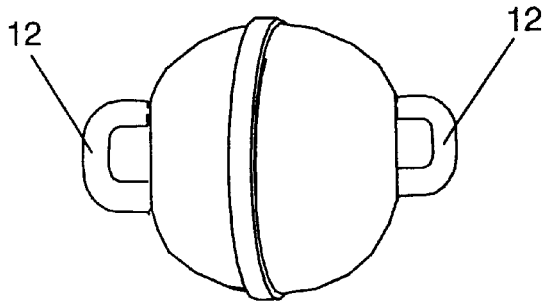

If the handles are rigidly attached to the housing, they will, as shown in FIGS. 13 and 14, preferably be located and oriented symmetrically with respect to the channel (or precession) plane, coincident with the precession axis $A_P$.

Figure 5:
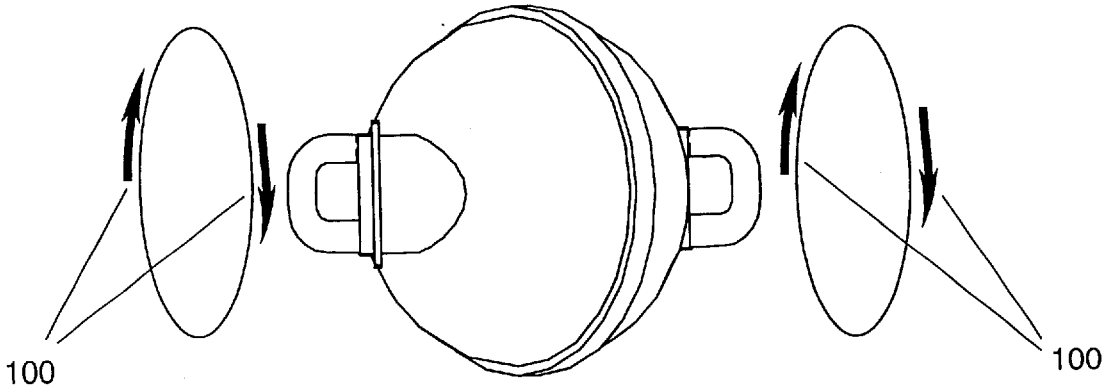
FIG. 5 is an external side view of the precessional device of FIG. 1, schematically showing the pedaling motion to be applied while using the device.
Figure 6:
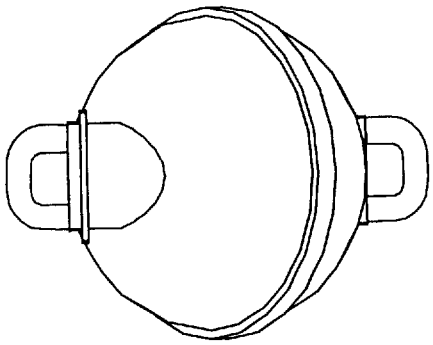
FIGS. 6–9 are additional external side views of the precessional device of FIG. 1, showing the orientation of the handles at four successive steps in the pedaling motion shown in FIG. 5.
Figure 8:
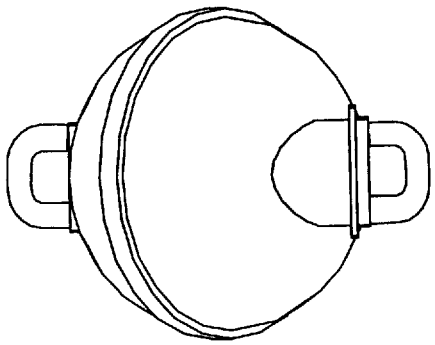
Figure 7:
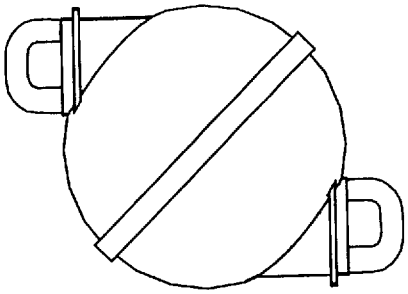
Figure 9:
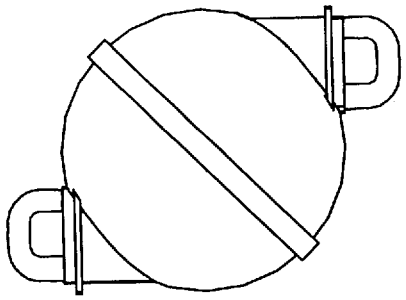

If the handles are movably coupled to the housing, they will, as shown in FIGS. 1 and 3, also preferably be located symmetrically with respect to the precession (or channel) plane, coincident with the precession axis. However, the orientation of the handles may be non-symmetric. For example, the handles shown in the embodiment of FIG. 1 are not mirror images of each other—rather, the handle on the left side of the device is pointing upwards, whereas the handle on the right side is pointing downwards. As will become more apparent in the discussion below, this non-symmetric configuration permits a circular pedaling motion, as shown in FIGS. 5 Mar. 8, 2001-9. The movable coupling may be accomplished by known means including, without limitation, a rotational coupling, pivot, or universal joint. If the handles are to be rotationally coupled to the housing, this coupling may be accomplished by appropriate known methods including, without limitation, a captured ball joint, circular thrust bearing, etc., and the handles will rotate relative to the housing about a crank axis ACR associated with each handle, as shown in FIG. 3.

As shown throughout the drawing figures, track 10 is preferably in the form of an annular ring having a channel 14 disposed in an interior surface thereof. When circumferential mating surfaces 7 of the hollow shell pieces 5 are secured to opposite sides 12 of the interposed track 10, the channel 14 is disposed equatorially about the inner periphery of the housing 2.

The shell pieces 5, handle-coupling portions 15, track 10, and handles 8 may be fabricated as separate elements from any suitable material and process for later assembly. Furthermore, any combination of the shell pieces, handle-coupling portions, track and/or handles may be formed as an integral assembly, for example out of molded plastic. When fabricated as separate elements, the various pieces may be secured to one another by any appropriate means, such as glue, screws, press-fitting, mating threads, etc.

The basic operation of the gyroscopic precessional exercise device is as follows, with the details of the initiation of the rotor spin and precession described below. A user, desiring an upper body workout, for example, sets the rotor spinning about the spin axis $A_S$. The user then grasps the handles 8 and sets the entire rotor assembly precessing about the precession axis $A_P$. As the rotor assembly (with the rotor spinning) precesses around the precession axis $A_P$, it produces a gyroscopic precessional torque that induces a wobbling motion of the device. It is this wobbling motion that, when resisted by the user, will provide the exercise effect.

The user exercises by applying muscular force to counter the wobbling motion. In the device of the present invention, the muscular force is applied by the user in a circular motion of the handles, using his hands and arms (in this example)—this motion provides a force which acts as a continuous deflecting torque on the spin axis of the rotor, reinforcing the precessional motion about the track.

In the embodiment having handles rotationally coupled to the housing, the user-applied motion is similar to the hand-cranking motion used in some types of recumbent bicycles. The circular pedaling motion 100, shown schematically in FIG. 5, is shown in detail in FIGS. 6–9 at four incremental steps separated 90 degrees. It will be appreciated from the figures that as each handle moves in its circular path, it rotates about an axis of rotation, or crank axis, so as to maintain a fixed orientation in inertial space. That is, in FIGS. 6–9, the portion of the handles which are meant to be grasped by the hand remain vertical throughout the entire pedaling cycle. For ergonomically correct operation, the crank axes of the handles are preferably parallel. The diameter of the circle in which the handles are moved is determined by the offset of the crank axes from each other, and is a matter of design choice.

As compared to the precessional exercise devices known in the art which have no handles or rigidly-affixed handles, the rotatable handles of the device of the present invention permit the handles to remain in a given orientation in inertial space as the user moves them in a circular pedaling motion. Advantageously, the pedaling motion and the fixed orientation of the handles is more ergonomically appropriate for exercising than known designs, and provides good exercise with reduced repetitive stress on the joints of the user, particularly the wrist joint.

In another embodiment of the device of the present invention, the handles are offset from the precession plane. In this embodiment, the handles may be rigidly coupled to the housing, or may be coupled to the housing using a pivotal connection such as a universal joint.

Known devices with no handles are used by grasping the device like a ball, and rotating the hand around the wrist in a tight circular motion, while the rest of the arm remains stationary. As discussed above, known devices with handles are used by grasping handles which are located on the precession plane, and attempting to continuously deflect the precession axis. This requires a large and awkward articulation of the wrists. The required motion can be analogized to that required when grasping a plate at either side, and attempting to roll a marble around the circumference of the plate. When the handles are offset from the precession plane as in this embodiment of the present invention (handles located, for example, on or near the precession axis), it is possible for even rigidly-coupled handles to be manipulated in a circular motion to operate the device. This smooth and convenient circular motion involves primarily the joints of the elbow and shoulder, and the large muscle groups associated therewith. Such a design advantageously targets the large muscle groups for exercise, provides a greater range of motion, and presents reduced risk of fatigue in the wrist and forearms. The end result is that the device of this embodiment of the present invention provides an exercise technology suitable for a wider range of exercise applications than known devices.

The counter-force exerted by the user will accelerate the precession rate of the rotor assembly (as well as the spin rate of the rotor), thereby increasing the resistive force to the user. Those of skill in the art will appreciate that by a given modulation of the amount of applied counter-force, the user may increase the resistive force to a high level, resulting in a high-intensity, short duration "strength workout." Alternatively, by another modulation of the amount of applied counter-force, the user may reduce the resistive force to a lower level, resulting in a lower-intensity, long duration "endurance workout." In this way, the device of the present invention may be used both for strength/muscle-building exercises and for aerobic fitness exercises.

Figure 10:
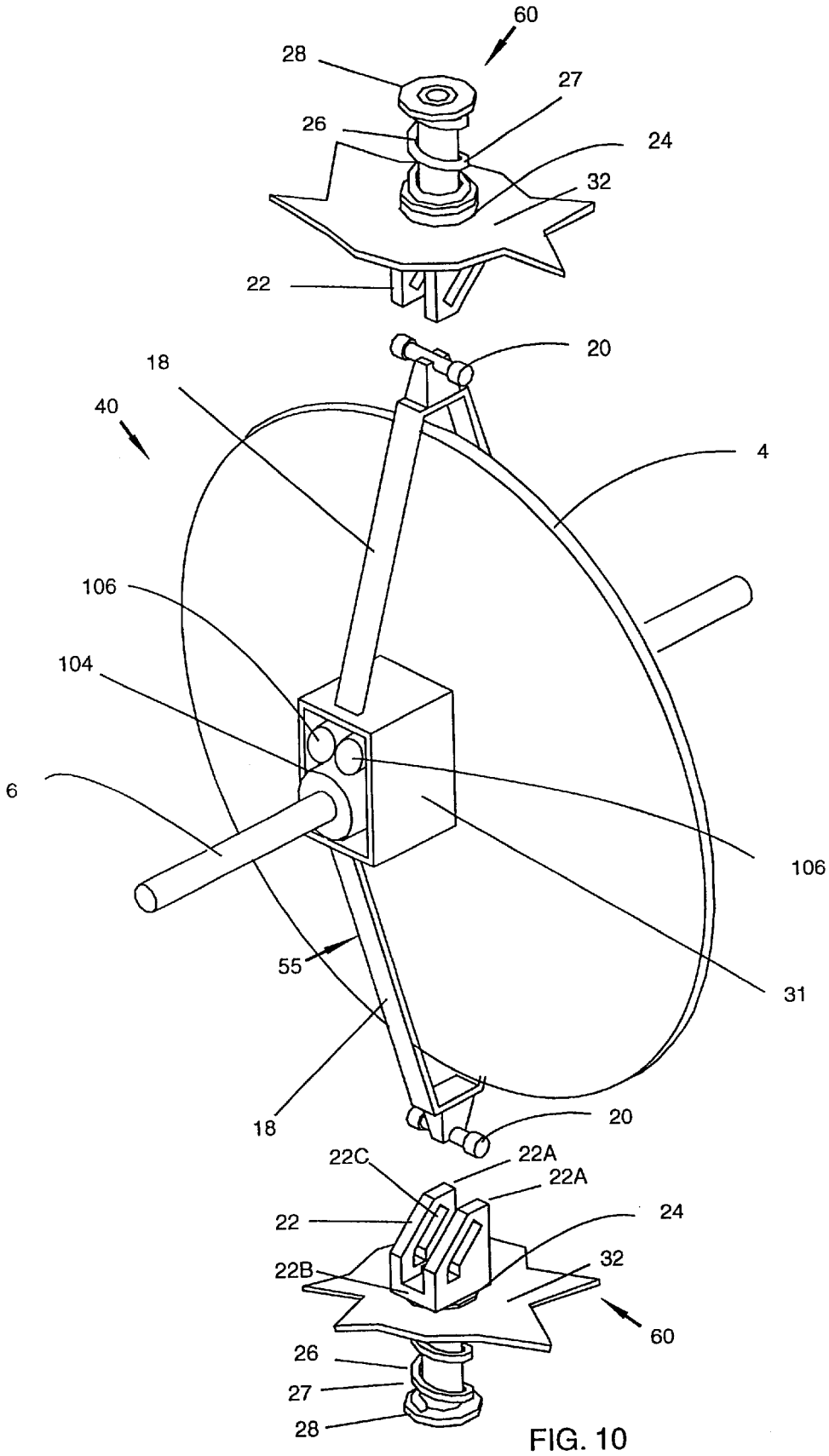
FIG. 10 is an exploded perspective view of an embodiment of the rotor assembly of the precessional device of the present invention.
Figure 11:
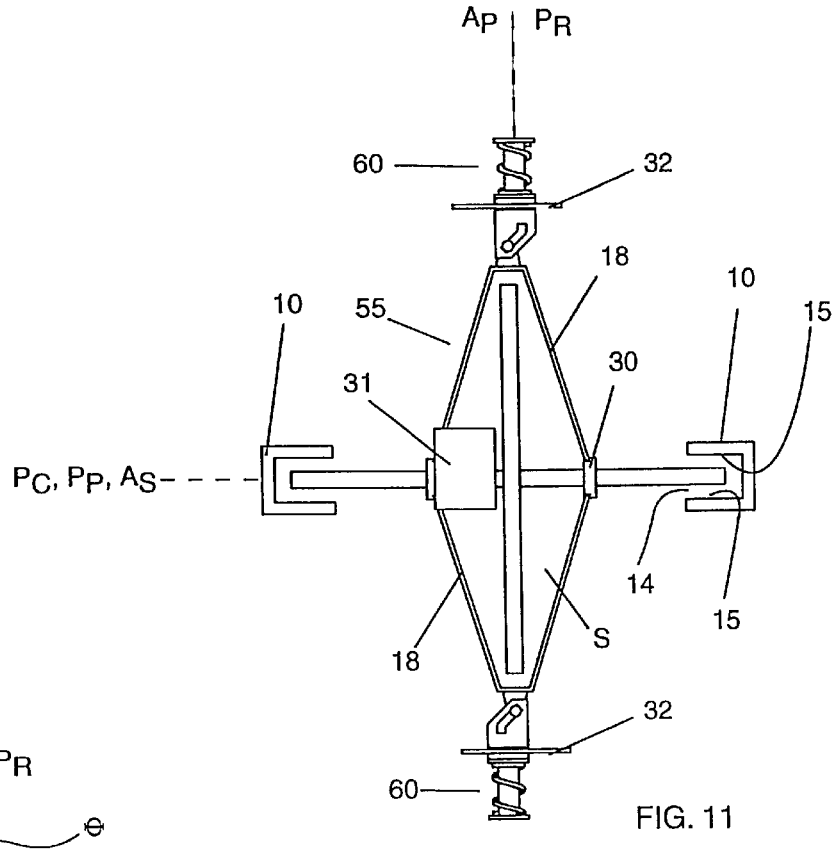
FIGS. 11 and 12 are side views of the rotor assembly and sectional views of the channel of precessional device of the present invention, in two different positions.
Figure 12:
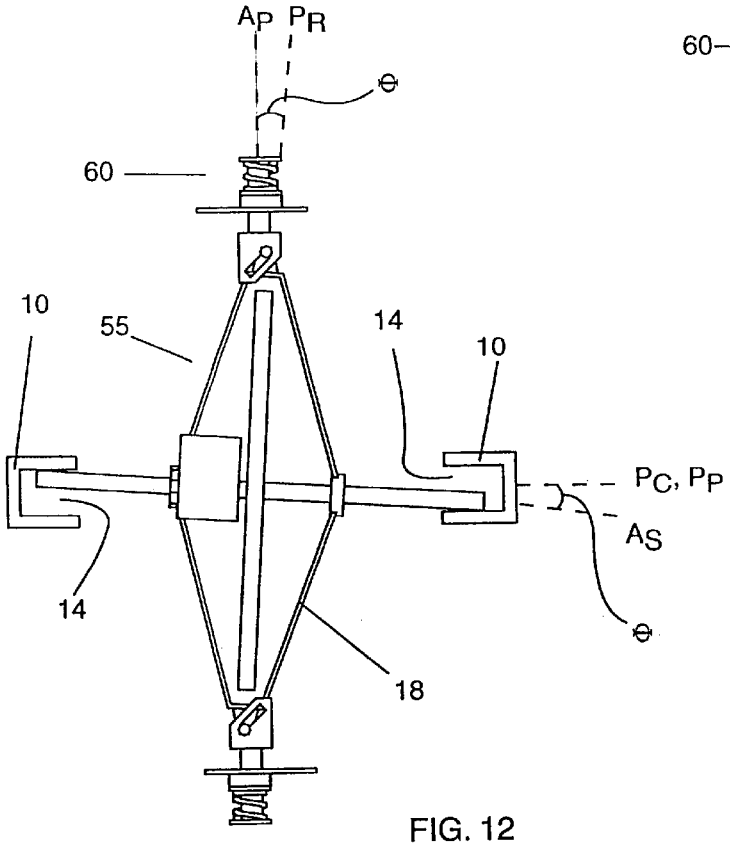

The structure and operation of an embodiment of the gyroscopic precessional exercise device of the current invention which includes a tilting mechanism is best understood with reference to FIGS. 10–12.

The rotor assembly has an associated rotor plane "$P_R$" which is defined as a fixed plane perpendicular to the longitudinal axis of the axle (the spin axis $A_S$). In the initial or nominal state of the device shown in FIG. 11, the spin axis is parallel to the channel plane $P_C$, and the rotor plane is orthogonal to the channel plane $P_C$ and parallel to the precession axis "$A_P$". But because the vertical dimension of the channel 14 and the diameter of the axle 6 are selected so as to allow the axle to be freely received within the channel, the axle may tilt relative to the channel. In a tilted state of the device, as shown in FIG. 12, the axle is in contact with the horizontal surfaces of the channel, the spin axis $A_S$ is not parallel to the channel plane $P_C$, and the rotor plane $P_R$ is not parallel to the precession axis $A_P$. Specifically, the spin axis $A_S$ is tilted at an angle $\theta$ to the channel plane $P_C$ and the rotor plane $P_R$ is tilted the same angle $\theta$ to the precession axis $A_P$.

The tilt angle $\theta$ depends on the dimensions of the channel and axle, and may generally be any angle greater than zero that causes the axle to come into contact with the horizontal surfaces of the channel. However, its has been determined through analysis and testing that the tilt angle $\theta$ is preferably no more than about 10 degrees, more preferably no more than about 3 degrees, and even more preferably no more than about 2 degrees. It has also been determined that the tilt angle is preferably at least about 0.1 degree, more preferably at least about 0.5 degrees, and even more preferably at least about 1 degree.

FIGS. 10–12 show an embodiment of the present invention which includes a tilting assembly. The tilting assembly includes a yoke 55 and tilt assemblies 60. The rotor 4 and at least part of the axle 6 are positioned within the supporting yoke 55. As will be explained in detail below, the tilt assemblies 60 selectively control the tilting of the rotor assembly from an initial untilted position (where the axle does not contact the channel) to a tilted position (where the axle contacts the channel).

In this embodiment, the rotor assembly 40 is rotatably secured within housing 2 along the precession axis $A_P$ by two opposing tilt assemblies 60. Portions of the housing associated with the tilt assemblies are shown as items 32 in FIG. 10, but the balance of the housing is not shown. The yoke 55 rotatably supports axle 6, such that the rotor can rotate about the spin axis $A_S$ relative to the yoke. Additionally, the yoke 55 is rotatably mounted within housing 2 by two opposing coaxial tilt assemblies 60 for rotation about the precession axis $A_P$ relative to the housing and the rest of the device. The precession axis $A_P$ is defined by the coaxial tilt assemblies 60. The tilt assemblies are positioned with respect to the housing so as to fix the position of the precession axis relative to the housing, while allowing the rotation of the rotor assembly around that axis. The tilt assemblies themselves may be rotatable relative to the housing in part or in whole—for example, as shown in FIG. 10, the tilt assemblies may be rotatably disposed through openings 24 in the housing.

As seen in FIGS. 11 and 12, the tilt assemblies are operative to divert the top and bottom ends of the yoke in opposite directions, so as to tilt the rotor assembly relative to the channel. In the embodiment of FIGS. 10–12, each tilt assembly 60 comprises a push rod 26, biasing element 27, head portion 28, and a pin slide 22. A head portion 28 is positioned at the distal end of each push rod 26, and a pin slide 22 is attached to the proximal end. Each push rod is movably disposed through an opening 24 in the housing 2, with the associated head portion 28 positioned outside the housing. Pin slides 22 are positioned inside the housing. The push rods are reciprocating members that extend from inside the housing to outside the housing. The biasing element 27 provides a biasing force which, unless overcome, biases each push rod 26 into an outwardly-extended position, as shown in FIG. 11. If the biasing element is a compression spring, the spring may be located around each push rod 26 and disposed between the associated head portion 28 and a portion of the exterior surface of the housing 2 surrounding the openings 24.

Each pin slide 22 comprises a generally "U" shaped member having two sides 22A connected together by a third side 22B. Each pin slide 22 includes a pair of axially aligned cam grooves 22C disposed in sides 22A. Each pair of cam grooves 22C slidably receives a respective one of the pin locks 20 of the yoke 55. When the push rods 26 are in the extended position, as shown in FIG. 11, the rotor assembly 55 is positioned such that the spin axis $A_S$ is parallel to the channel plane $P_C$ and the rotor plane $P_R$ is parallel to the precession axis $A_P$, and such that the axle makes no contact with the internal surfaces of the channel 14. In this position or arrangement, the rotor assembly is said to be "disengaged," because the axle moves freely within the channel, such that even if it is spinning, it does not induce rotation of the rotor assembly about the precession axis $A_P$.

On the other hand, when the push rods 26 are forced into the housing 2 into their retracted position shown in FIG. 12, the interaction of the pin locks 20 with the cam grooves 22C causes a tilting of the yoke 55 by a tilt angle θ. Specifically, as the push rods 26 are being pushed toward the housing 2 to the retracted position, each pin lock 20 slides along each pair of axially aligned cam grooves 22C from the position shown in FIG. 11 to the position shown in FIG. 12. The tilting of the yoke by tilt angle θ results in tilting the shaft axis $A_S$ relative to the channel plane $P_C$, as well as tilting the rotor plane $P_R$ relative to the precession axis $A_P$, both by the tilt angle θ. When the tilt assembly is adjusted into this position or arrangement, the rotor assembly is said to be "engaged," because the axle 6 contacts the inner surfaces 15 of the channel 14. Friction generated between the spinning axle and the interior surfaces 15 of the channel 14 cause the axle to race around the channel 14, thereby precessing the rotor assembly around the precession axis $A_P$. It will be appreciated that the pin lock 20 serves as a first linkage assembly associated with the rotor assembly, and the pin slide 22 and push rod 26 serve as a second linkage assembly associated with the housing. These linkage assemblies are operatively associated, to adjust the tilt assembly between the first position (where the axle is not in contact with the channel) and the second position (where the axle contacts the channel).

In the preferred embodiment, head portions 28 of the tilt assemblies 60 are associated with the handles 8 so that when a user engages the handles with sufficient force to overcome the biasing effect of biasing element 27, the tilt assemblies are pushed inward for engaging the rotor assembly 40. A sufficient relief of this engagement force allows the tilt assemblies 60 to return to their outwardly biased position, under the force of the biasing element 27, and disengage the rotor assembly.

The operation of the embodiment of the gyroscopic precessional exercise device including the tilting assembly is as follows. A user, desiring an upper body workout (for example), sets the rotor spinning about the spin axis (using a motor, for example) and grasps the handles 8 with his hands. Once the user has applied a sufficient engagement force to the handles to overcome the biasing force of the biasing elements 27, the tilt assemblies 60 will be pushed and held inward, forcing the rotor assembly into the engaged position. As discussed above, the friction generated between the axle 6 and the interior surfaces 15 of the channel 14 causes the entire rotor assembly to precess around the precession axis $A_P$, and this precession of the spinning rotor produces a gyroscopic precessional torque. This precessional torque induces a harmonic wobbling motion in the device—resistance to this motion exercises the muscles of the user.

During use, the user applies a counter force, using a circular motion of the handles, against the resistive forces of the motion induced in the device. The circular motion in the rotationally-coupled handle embodiment of FIG. 5 is a pedaling motion depicted by arrows 100. The rotational coupling of the handles to the housing permits handles 8 to remain in a fixed orientation in inertial space even as they are moved along the circular path proscribed by the pedaling motion.

Termination of the resistive wobbling motion, during hand use, is obtained when the user releases sufficient hand or grip pressure to allow the tilt assemblies 60 to be biased outwardly by the biasing elements 27 and thereby to disengage the rotor assembly from the channel. Because the spinning rotor axle does not frictionally engage the channel in this disengaged arrangement, the rotor assembly is not encouraged to precess, and any residual precessional motion about the precession axis will die out due to frictional effects.

It will be appreciated that the tilting assembly not only provides a way to initiate precession of the rotor assembly, but also serves as a safety mechanism.

Should a user, during an exercise session, accidentally lose control of the exercise device by losing engagement of the handles, the biasing elements will cause the rotor assembly to be disengaged from the channel.

Figure 17:
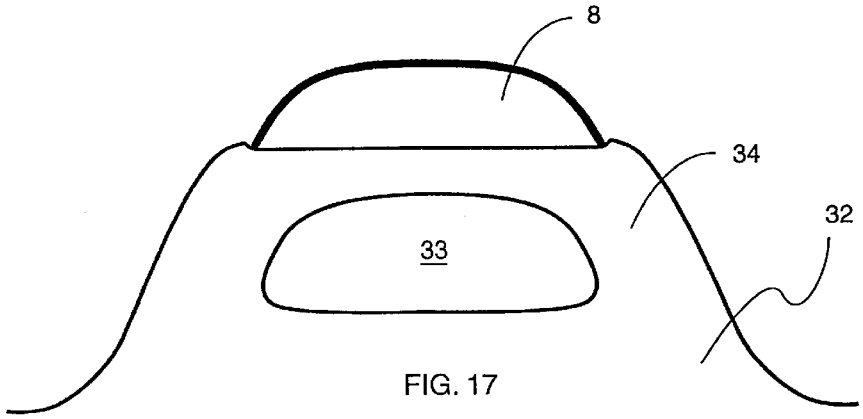
FIG. 17 is a partial side view of one embodiment of a handle and housing of the precessional device of the present invention.
Figure 18B:
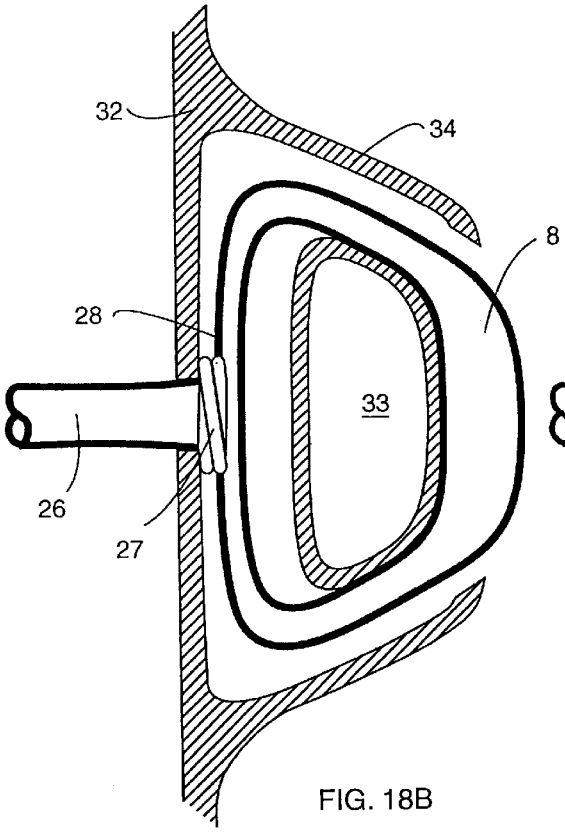
FIGS. 18A and 18B are partial side sectional views of the embodiment of a handle and housing shown in FIG. 17, with the handle in two different positions.
Figure 18A:
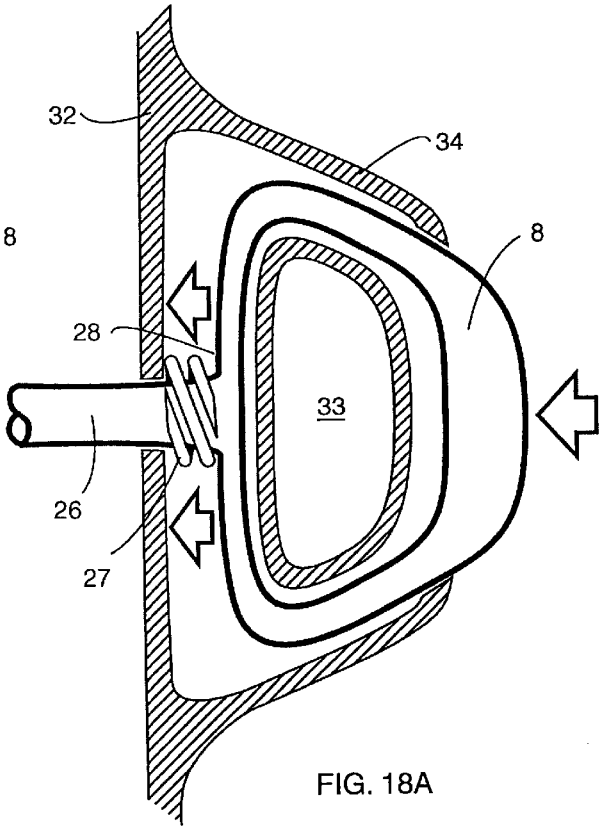

FIGS. 17, 18A, and 18B depict one embodiment of the handle-operated tilt assembly of the present invention. A portion of the handle 8 is accessible through an opening in the housing 32. The user grasps the handle by engaging the handle bore 33 with part of his hand, and the accessible part of the handle with another part of his hand. By applying manual pressure to overcome the biasing force of biasing element 26, the handle can be displaced from the initial position of FIG. 18A (corresponding to FIG. 11, where the rotor assembly is in the disengaged position) to the position of FIG. 18B (corresponding to FIG. 12, where the rotor assembly is in the engaged position).

Figure 19:
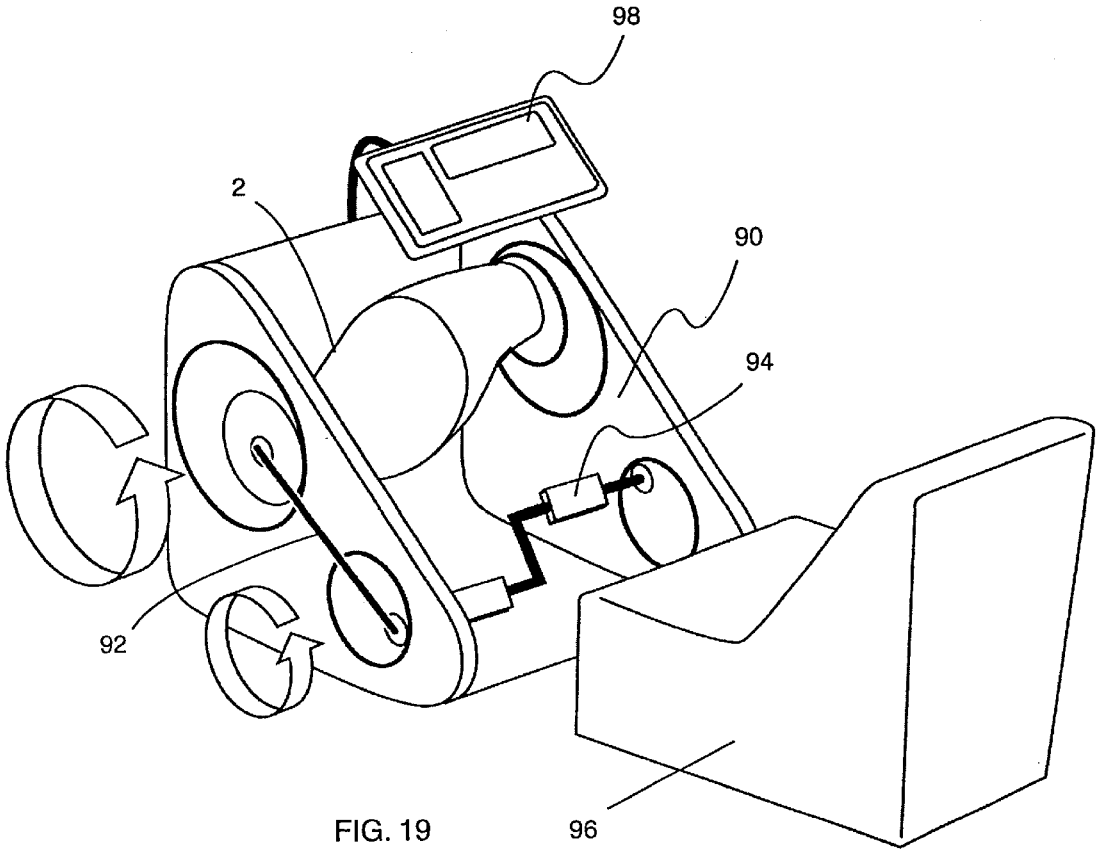
FIG. 19 is a perspective view of an embodiment of the precessional device of the present invention suitable for a lower body workout.

As noted earlier, the counter muscular force may be applied by either the hands and arms of the user or the feet and legs of the user depending on whether an upper or lower body workout is desired. An embodiment of a system incorporating the device of the present invention, suitable for a lower body workout is depicted in FIG. 19. The housing 2 is supported by a frame 90. Instead of handles, a movable linkage 92 is coupled to the housing. The linkage is also coupled to pedals 94. The user can sit in chair 96 and operate the pedals with his feet to apply the counter muscular force in order to get a lower body workout. The system may also be provided with a panel 98 which can be used to control and/or monitor the operation of the device. Additionally, two exercise devices could be used at the same time for acquiring simultaneous upper and lower body workouts. With prolonged use, the precessional gyroscopic exercise device provides for a vigorous and healthy aerobic workout of several major muscle groups.

The embodiment of the device of the present invention shown in FIGS. 10–12 includes an electric motor 104. It will be appreciated that the motor can be selectively operated with suitable circuitry, to set the rotor spinning around the spin axis in initial step of the example of use given above. The operation of the motor will contribute to the spin of the rotor about the spin axis. In the embodiment in which the rotor assembly tilts and the axle comes into contact with the channel, the force applied by the user will also contribute, through interaction of the channel and axle, to the spin of the rotor about the spin axis. In the embodiment which has no channel, the user-applied force does not contribute to the spin of the rotor about the spin axis, and the motor alone controls that spin.

In the motor-driven embodiment as shown in FIGS. 10–12, the axle 6 is preferably the shaft of a standard electric DC motor 104, although the axle 6 may also be driven from the motor shaft through a transmission. The motor may be a conventional electric DC motor, for example, powered by batteries 106.

As seen in FIG. 11, yoke 55 comprises two generally "V" shaped yoke pieces 18. The yoke pieces are secured together at a bearing 30 on one side of the rotor, and at a motor casing 31 on the other side of the rotor. The yoke pieces, bearing, and motor housing are arranged so as to define an interior space S within the yoke 55. When motor 104 is properly positioned and secured in motor casing 31, axle 6 freely extends through bearing 30. With this arrangement, rotor 4 is disposed within the space S. Axle 6 is rotatably supported by both the motor 104 within the motor casing 31, and the bearing 30 through which it extends.

The conventional motor may be used to convert the electrical energy it receives from batteries 106 into a mechanical rotation of axle 6. The batteries may be of any known type, but are preferably of the rechargeable type. The various components, such as the motor, battery and rotor, are preferably selected and located such that the center of mass of the overall device lies near the geometric center of the device. Most preferably, the center of mass of the device will lie on or near the axle, and on or near the precession axis.

Figure 15:
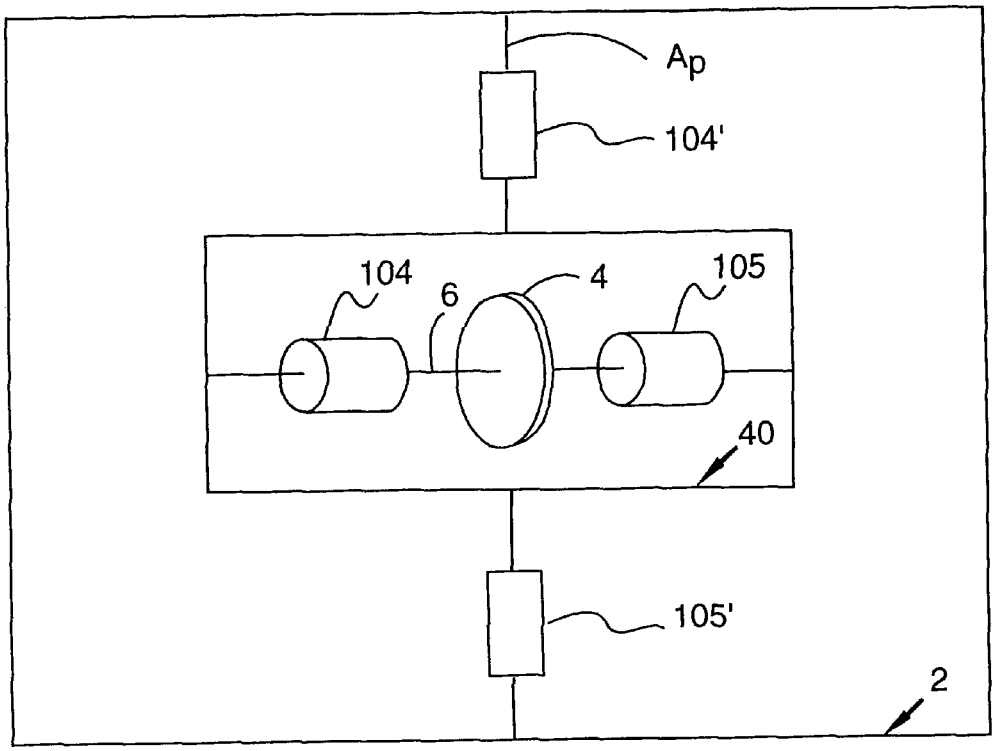
FIG. 15 is a schematic illustration of the precessional device of the present invention, in an embodiment having a motor and a generator associated with each of the rotor and the rotor assembly.

With suitable known circuitry, the structure of the motor may also be used as a generator. In this embodiment, the kinetic energy of: (i) the rotor spinning about the spin axis and/or (ii) the rotor assembly rotating about the precession axis is converted by the motor/generator into electrical energy which can advantageously be used to recharge the batteries. Alternatively, separate generators 105 (for conversion of the kinetic energy (i) described above) and/or 105' (for conversion of the kinetic energy (ii) described above) may be provided in addition to the motor(s) 104 and/or 104', as shown in FIG. 15. The electrical energy generation can be accomplished at any time during the operation of the device, but it will most advantageously be used when the rotor and rotor assembly are spinning down, at the end of a session.

Although the tilting assembly has been discussed in detail above, that assembly is simply one way to contribute to rotation of the rotor assembly around the precession axis. Specifically, it will be appreciated that the tilting mechanism is a mechanism for converting the energy of the spinning rotor into a rotation of the entire rotor assembly about the precession axis.

Alternatively, other techniques may be employed to cause rotation of the rotor assembly about the precession axis. In one embodiment, the rotor assembly will be manually tiltable, such that manual gyration of the device may be applied to create a torque which tends to cause the ends of the rotor axle to be pressed against the opposing faces of the channel.

Figure 16:
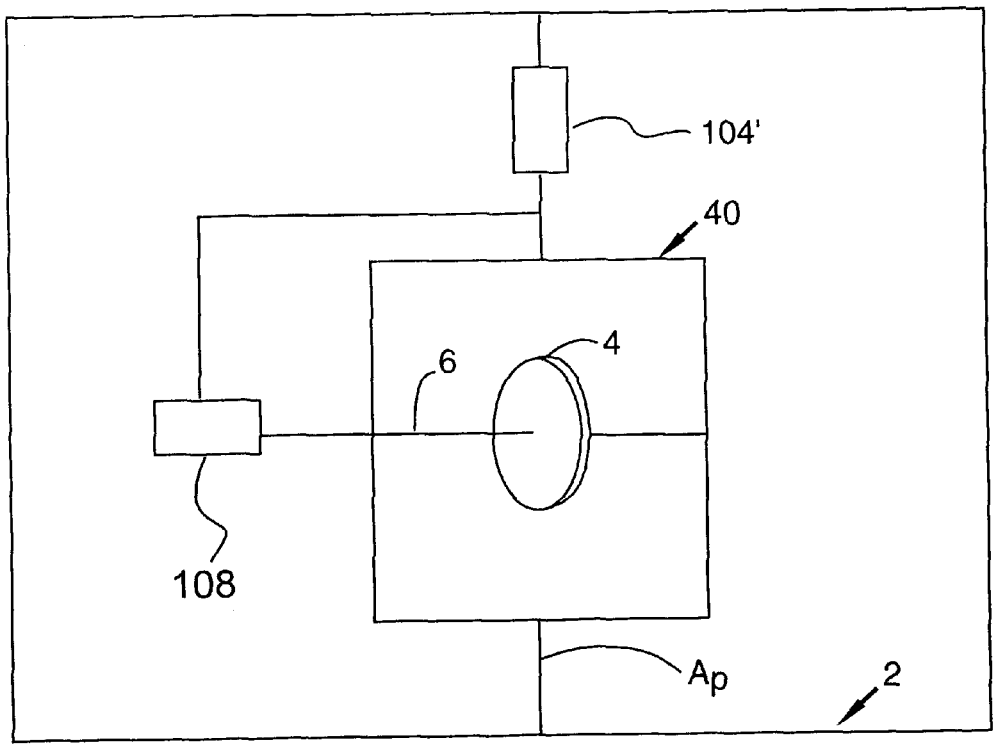
FIG. 16 is a schematic illustration of the precessional device of the present invention, in an embodiment having a motor and generator directly associated with the rotor assembly, and a transmission coupling the rotor to that motor.

In another embodiment, a motor/generator 104', as shown in FIGS. 15 and 16, could be employed to provide the power to cause the rotor assembly to precess about the precession axis. As for the motor used to drive the spin of the rotor about the spin axis, the motor used to drive the precession may simply contribute to the precession, or may control it altogether, with no effect from the user-supplied force.

It will be understood that in such a fully-motorized embodiment of the device of the present invention, if the spin and precession rates are completely controlled by the motor(s), there will be a fixed magnitude of the wobbling effect, and correspondingly, a fixed amount of user-supplied force required to oppose the wobbling. In contrast, in the embodiment where the user-supplied force can affect the spin and/or precession rates, a "feedback" effect is present, as the user-supplied force can, if properly applied, increase the spin and/or precession rates, increasing the magnitude of the induced wobbling, which in turn increases the magnitude of the user-supplied force required to counteract that wobbling.

In the motorized-precession embodiment, the rotor assembly does not need to be tiltable relative to the housing and no tilting mechanism or track would be required, as the precession about the precession axis would be motor-driven, rather than resulting from frictional contact between the axle ends and a channel. Accordingly, it is possible to have a fully motor-driven embodiment of the device of the present invention, in which both the rotor spin and precession are driven by a motor.

Separate motors/generators may be used to drive the spin and precession, as shown in FIG. 15, or a single motor/generator may be used, with a suitable transmission system 108, as shown in FIG. 16. The circuitry for controlling the motor function may be by appropriate known methods, such as radio control, or suitable wiring connected to the housing via the yoke 56.

It will be appreciated that in some embodiments of the invention which use motors to control the spin and/or precession rates, the manipulation of the device by the user will not affect these rates. Accordingly, the device will not operate to "feedback" the effects of the user's manipulation to the user, but will simply provide a fixed amount of exercise effect, as determined by the motor driving rates. It is desirable in some instances to de-couple the spin and/or precession rates from the induced motion of the user in this way, as this will lead to more precise control of the exercise effect of a given workout, and will also avoid any possible negative effects which might occur from operation of the device at a resonance frequency.

While the invention has been described in detail and with specific reference to specific embodiments thereof, it will be apparent to one having ordinary skill in the art that various changes and modifications can be made therein without departing from the spirit and scope of the invention provided they come within the scope of the appended claims and their equivalents. For example, although the figures depict handles which are best suited for engaging with a user's hands, it will be appreciated that the handles could be constructed so as to be well-suited for engaging with a user's feet, without departing from the spirit of the invention. Accordingly, it should be understood that the embodiments herein are merely illustrative of the principles of the invention. Various modifications may be made by those skilled in the art which will embody the principles of the invention and fall within the spirit and the scope thereof.

What is claimed is:

1. An apparatus comprising:

a housing having a precession axis;

a rotor assembly comprising a rotor and an axle, the axle having a longitudinal axis defining a spin axis for the rotor; and first and second handles, each handle being movably coupled to the housing;

wherein the rotor is rotatable relative to the housing about the spin axis and the rotor assembly is rotatable relative to the housing about the precession axis.

2. The apparatus of claim 1, wherein the movable coupling of the handles to the housing is a rotational coupling, each handle having an associated crank axis, each handle being rotatable, about its crank axis, relative to the housing.

3. The apparatus of claim 2, wherein each handle is moveable in a circular path in a plane substantially perpendicular to its crank axis, and wherein each handle remains in substantially the same orientation during its motion in the circular path.

4. The apparatus of claim 3, wherein the crank axes of the first and second handles are substantially parallel.

5. The apparatus of claim 4, wherein the crank axes of the first and second handles are offset from each other.

6. The apparatus of claim 5, wherein the motion of the first and second handles in their circular paths contributes to the rotation of the rotor assembly about the precession axis.

7. The apparatus of claim 1, wherein the handles are located on or near the precession axis.

8. An apparatus comprising:

a housing having a precession axis;

a rotor assembly comprising a rotor and an axle, the axle having a longitudinal axis defining a spin axis for the rotor;

a precession plane substantially perpendicular to the precession axis; and first and second handles coupled to housing, offset from the precession plane;

wherein the rotor is rotatable relative to the housing about the spin axis, and the rotor assembly is rotatable relative to the housing about the precession axis.

9. The apparatus of claim 8, wherein the handles are rigidly coupled to the housing.

10. The apparatus of claim 8, wherein the handles are movably coupled to the housing.

11. The apparatus of claim 10, wherein the movable coupling of the handles to the housing is a universal joint.

12. The apparatus of claim 10, wherein the movable coupling of the handles to the housing is a rotational coupling, each handle having an associated crank axis, each handle being rotatable, about its crank axis, relative to the housing.

13. The apparatus of claim 12, wherein each handle is movable in a circular path in a plane substantially perpendicular to its crank axis, and wherein each handle remains in substantially the same orientation during its motion in the circular path.

14. The apparatus of claim 12, wherein the crank axes of the first and second handles are substantially parallel.

15. The apparatus of claim 12, wherein the crank axes of the first and second handles are offset from each other.

16. The apparatus of claim 13, wherein the motion of the first and second handles in their circular paths contributes to the rotation of the rotor assembly about the precession axis.

17. The apparatus of claim 8, wherein the handles are located along or near the precession axis.

18. The apparatus of claim 1, wherein the handles are offset from the precession plane.

19. The apparatus of claim 1, wherein the movable coupling of the handles to the housing is a universal joint.

* * * * *